United States Patent [19]

Noguchi et al.

[11] 4,175,523

[45] Nov. 27, 1979

[54] INTERNAL COMBUSTION ENGINE AND A METHOD FOR OPERATION THEREOF

[75] Inventors: Masaaki Noguchi, Nagoya; Masaharu Sumiyoshi, Toyota; Tsuchio Bunda, Okazaki; Taro Tanaka, Chiryu, all of Japan

[73] Assignee: Nippon Soken, Inc., Nishio, Japan

[21] Appl. No.: 890,901

[22] Filed: Mar. 27, 1978

[30] Foreign Application Priority Data

Mar. 29, 1977 [JP] Japan ..... 52-35008

[51] Int. Cl.[2] ..... F02M 25/06; F02B 43/08

[52] U.S. Cl. ..... 123/119 A; 123/3

[58] Field of Search ..... 123/3, 119 A

[56] References Cited

U.S. PATENT DOCUMENTS

| | | | |
|---|---|---|---|
| 1,625,007 | 4/1927 | Weeber | 123/119 A |
| 3,855,890 | 12/1974 | Weisz et al. | 123/3 |
| 3,908,606 | 9/1975 | Toyoda et al. | 123/3 |
| 3,980,052 | 9/1976 | Noguchi et al. | 123/3 |
| 4,059,076 | 11/1977 | Kosaka | 123/3 |
| 4,074,661 | 2/1978 | Noguchi et al. | 123/3 |

*Primary Examiner*—Wendell E. Burns

*Attorney, Agent, or Firm*—Cushman, Darby & Cushman

[57] ABSTRACT

An internal combustion engine is provided with an EGR system and a system for catalytic coversion of a rich air-fuel mixture into a reformed combustible gaseous mixture rich with free hydrogen. During a low or medium engine load engine operation, the engine is operated solely by an air-gasoline mixture and with an exhaust gas recirculation at a rate not higher than a predetermined first EGR rate. During a high engine load engine operation, the reformed combustible gaseous mixture is added to the air-gasoline mixture supply and simultaneously the exhaust gas recirculation is increased to a rate higher than the predetermined first EGR rate to increase the engine output, improve the engine drivability and improve the consumption of the reformed combustible gaseous mixture. The intake manifold vacuum is electrically detected to determine the load on the engine and to control valves associated with the EGR system and reformed gas supply system.

18 Claims, 2 Drawing Figures

INTERNAL COMBUSTION ENGINE AND A METHOD FOR OPERATION THEREOF

RELATED APPLICATION

This application is generally related to the applicants' earlier copending application Ser. No. 641,603, now abandoned filed Dec. 17, 1975. The disclosure in the earlier application is incorporated herein by reference.

BACKGROUND OF THE INVENTION

1. Field of the Invention

The present invention relates to an internal combustion engine and a method of operation thereof and, more particularly, to an internal combustion engine equipped with a fuel reforming system and an exhaust gas recirculation system (EGR system) and a method for the operation of the engine of the type specified.

2. Description of the Prior Art

Internal combustion engines equipped with fuel reforming systems have heretofore been proposed to simultaneously reduce kinds of harmful components of engine exhaust gases and to improve the engine drivability.

The internal combustion engine of this type has been operated by the supply of combustible gases at a lean air-fuel ratio such as from 18 to 22, for example. The combustible gases consisted of a mixture of air and gasoline and a reformed gaseous mixture produced by the reformation of a hydrocarbon fuel, such as gasoline, or an alcohol, such as methanol or ethanol. The engine was operated in such a manner that the reformed gaseous mixture was always supplied into the engine regardless of the engine operating conditions. In the case where a hydrocarbon fuel was used to produce a reformed gaseous mixture, an energy loss occurred in the fuel reforming process. This manner of engine operation, therefore, has not much contributed to the improvement in the total fuel consumption rate.

The use of an alcohol to produce a reformed combustible gaseous mixture is advantageous in that alcohol is easy to reform and energy loss hardly occurs. However, difficulties have been found in the use of alcohols that gaseous combustible mixtures obtained by the reformation of alcohols are more expensive than other kinds of reformed gaseous mixtures and the calorie per unit volume of an alcohol is lower than that of gasoline with a resultant increase in the fuel consumption.

SUMMARY OF THE INVENTION

It is an object of the present invention to provide an improved engine operation method which minimizes the consumption of a reformed combustible gaseous mixture to improve the fuel consumption of an engine, reduces the emission of harmful engine exhaust gas components and improves engine drivability.

According to the method of the present invention, an internal combustion engine provided with an EGR system and a fuel reforming system for converting a rich mixture of air and a fuel into a reformed combustible gaseous mixture rich with free hydrogen is operated such that, when the load on the engine is lower than a predetermined load level, the combustion chamber of the engine is supplied with a mixture of air and gasoline and the engine exhaust gases are recirculated back into the combustion chamber at a rate not higher than a predetermined first EGR rate and such that, when the engine load exceeds the predetermined load level, the reformed combustible gaseous mixture is added to the air-gasoline mixture supply and substantially simultaneously the exhaust gas recirculation is increased to a rate higher than the predetermined first EGR rate.

It is another object of the present invention to provide an internal combustion engine with an EGR system, a fuel reforming system for converting a rich mixture of air and a fuel into a reformed combstible gaseous mixture rich with free hydrogen and feeding the reformed mixture into an intake system of the engine, and means responsive to variation in the load on the engine to control the exhaust gas recirculation and the supply of the reformed combustible gaseous mixture from the fuel reforming system into the intake system so that the exhaust gas recirculation and the reformed gas supply are controlled in the manner specified above.

Preferably, the intake manifold vacuum may be electrically detected to determine the load on the engine to electrically actuate valves associated with the EGR system and the reformed gas supply system.

The above and other objects, features and advantages of the present invention will be made apparent by the following description with reference to the accompanying drawings.

DESCRIPTION OF A PREFERRED EMBODIMENT

Figure 1:
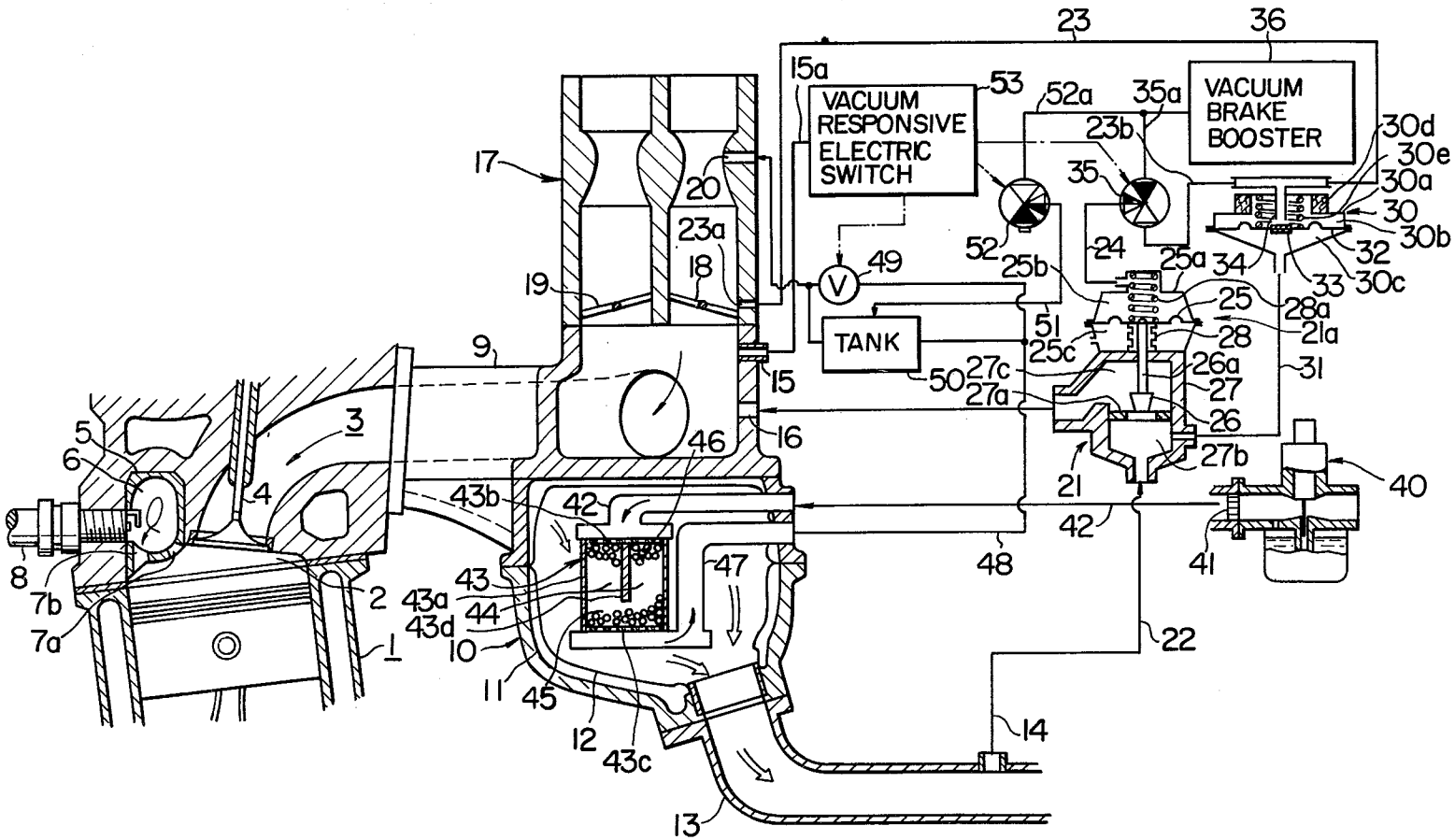
FIG. 1 is a partly sectional and partly diagrammatic illustration of an embodiment of an internal combustion engine according to the present invention.

Referring first to FIG. 1, a spark-ignition type, 4-stroke, reciprocal piston internal combustion engine 1 is shown as having a main combustion chamber 2 defined by a piston, a cylinder and a cylinder head. The main combustion chamber 2 is connected with an intake port 3 formed in the cylinder head. An intake valve 4 is mounted on the cylinder head and reciprocally movable in timed relationship with the engine crankshaft rotation. The intake valve 4 has a valve head which is reciprocally moved relative to a valve seat to control the communication between the main combustion chamber 2 and the intake port 3 in known manner.

The cylinder head is formed with a hole directed to the main combustion chamber 2. A trap chamber insert 5 is fitted into the hole and defines a trap chamber 6 the inner surface of which is smoothly curved and comprises an intermediate cylindrical surface and opposite concave hemispherical end surfaces smoothly and continuously connected to the intermediate cylindrical surface, respectively.

Two torch apertures *7a* and *7b* are formed in the trap chamber insert 5 in one of the ends thereof adjacent to the main combustion chamber 2 to intercommunicate the trap chamber 6 and the main combustion chamber 2. The ends of the torch apertures *7a* and *7b* adjacent to the trap chamber 6 are open thereto substantially tangentially to the inner surface of the chamber 6. The other end of the torch aperture *7a* is open to the main chamber 2 and directed generally toward the valve head of the intake valve 4 when the valve head is in its open position. The other end of the other torch aperture 7b is open to the main chamber 2 and directed substantially to the piston.

A spark plug 8 is mounted on the cylinder head so that a set of electrodes extend into the trap chamber 6 and disposed adjacent to the torch aperture 7b.

The intake port 3 is connected with an intake manifold 9. An exhaust port (not shown) is also formed in the cylinder head and connected with an exhaust manifold 10. The intake and exhaust manifolds 9 and 10 are connected together at their bottom and top. The exhaust manifold 10 is of a double-walled structure which comprises an outer shell 11 of a cast metal and an inner shell 12 disposed in the outer shell 11. The double-walled structure is effective to keep hot the interior of the exhaust manifold 10. The exhaust manifold 10 consists of upper and lower sections which can be separated apart.

The exhaust manifold 10 has an exhaust gas outlet to which an exhaust pipe 13 is connected. An exhaust gas delivery port 14 is formed in the exhaust pipe 13 and pneumatically connected to an exhaust gas recirculation system (EGR system) to be described later.

The intake manifold 9 is formed with a manifold vacuum port 15 and an exhaust gas recirculation port (EGR port) 16 and connected with a main carburetor 17 operative to produce a mixture of air and gasoline. The carburetor 17 is of 2-barrel, 2-stage type having primary and secondary fuel circuits in which primary and secondary throttle valves 18 and 19 are provided respectively and operable by an engine accelerator (not shown). A venturi in the primary fuel circuit upstream of the throttle valve 18 is provided with a port 20 which is pneumatically connected to a catalytic fuel reforming system to be described later.

The EGR system comprises an EGR line 22 extending between the exhaust gas delivery port 14 in the exhaust pipe 13 and the EGR port 16 in the intake manifold 9. An EGR control valve 21 is disposed in the EGR line 22 to control the recirculation of the engine exhaust gas back into the intake manifold 9. The EGR control valve 21 comprises a valve member 26 disposed in a valve housing 27. A partition 27a extends across the interior of the housing 27 to cooperate therewith to define two chambers 27b and 27c to which the upstream and downstream sections of the EGR line 22 are connected, respectively. The partition 27a is formed with a central opening to provide an annular valve seat with which the valve member 26 cooperates to control the flow of the engine exhaust gases from the exhaust pipe 13 to the intake manifold 9.

The valve member 26 has a valve steam 26a extending through an opening in the valve housing 27 into a valve actuator 21a and connected to a diaphragm 25 which extends across the interior of a diaphragm housing 25a and cooperates therewith to define a vacuum chamber 25b and an atmospheric chamber 25c. A bellows member 28 of a heat-resistant plastic material extends between the valve housing 27 and the diaphragm 25 and surrounds the valve stem 26a to prevent the recirculated engine exhaust gases from flowing from the chamber 27c into the atmosphere. A compression coil spring 28a is disposed in the chamber 25b to resiliently bias the diaphragm 25 toward the valve housing 27.

A throttle vacuum 23 is connected at one end to a port 23a formed in the main carburetor 17 adjacent to the primary throttle valve 18 to transmit the throttle vacuum to a throttle vacuum modulating valve 30 which is pneumatically connected by a line 23b to a three-way solenoid valve 35 which in turn is pneumatically connected by a line 24 to the vacuum chamber 25b in the diaphragm housing 25a of the EGR valve actuator 21a.

The throttle vacuum modulating valve 30 is operative in response to variation in the engine exhaust gas pressure to modulate the throttle vacuum to be exerted to the diaphragm 25 of the EGR valve actuator 21a. For this purpose, the throttle vacuum modulating valve 30 comprises a housing 30a, a diaphragm 32 disposed therein and cooperating therewith to define an atmospheric chamber 30b and an exhaust gas chamber 30c which is always communicated by a line 31 with the chamber 27b in the EGR valve housing 27. The atmospheric chamber 30b is communicated with the atmosphere through an annular filter 30d extending around a part of the chamber 30b. A compression coil spring 30e is disposed in the atmospheric chamber 30b to resiliently bias the diaphragm 32 toward the exhaust gas chamber 30c. The diaphragm 32 carries thereon a flat valve member 33 mounted on the diaphragm substantially centrally thereof. A T-shaped hollow tubular member 34 is rigidly mounted on the housing 30a so that the lower vertical portion or trunk of "T" extends into the atmospheric chamber 30b and has an inner end disposed in closely opposite relationship to the flat valve member 33. The upper horizontal portion or bar of "T" is disposed outside the housing 30a and has opposite ends connected to the vacuum lines 23 and 23b, respectively. It will be noted that the variation in the engine exhaust gas pressure is transmitted to the diaphragm 32 and deflects the same to move the flat valve member 33 relative to the inner end of the T-shaped tubular member 34 so that the flow of the atmospheric air into the tubular member 34 and thus into the vacuum lines 23, 23b and 24 and the vacuum chamber 25b of the EGR valve actuator 21a is varied to move the valve member 26 of the EGR control valve 21 relative to the valve seat provided by the partition 27a. The engine exhaust gas pressure is related to the flow of engine intake air. Thus, the rate of exhaust gas recirculation as controlled by the cooperation of the throttle vacuum modulating valve 30 and the EGR control valve 21 is related to the rate of engine intake air flow. The EGR rate may be properly set by the choice of the forces of the compression springs 28a and 30e resiliently acting on the diaphragms 25 and 32, respectively.

The fuel reforming system includes an auxiliary carburetor 40 provided to produce a rich mixture of air and a fuel to be reformed, such as an alcohol or a hydrocarbon fuel such as gasoline. In the illustrated embodiment of the invention, the carburetor 40 is an SU carburetor of variable venturi type. A flame arrester 41 is provided in a rich-mixture passage 42 to prevent back fire. The rich-mixture passage 42 extends into the exhaust manifold 10 to introduce the rich mixture of air and fuel from the auxiliary carburetor 40 into a catalytic reforming reactor 43 disposed in the exhaust manifold 10. The rich mixture produced by the auxiliary carburetor 40 contains a fuel part which is substantially in the form of liquid droplets which, when passing through the part of the passage 42 disposed in the exhaust manifold are heated and evaporated by the heat of the engine exhaust gases.

The reactor 43 is to catalytically convert the rich air-fuel mixture from the auxiliary carburetor 40 into a reformed combustible gaseous mixture rich with hydrogen gas and comprises a vessel 43a which cooperates with perforated end plates 43*b* and 43*c* to define a catalytic reforming chamber which is partly divided into parallel upstream sections 44 having downstream ends communicated with each other by a downstream end section 45 disposed adjacent to the perforated end plate 43*c*. The sections 44 and 45 are filled with catalyst particles which form a catalyst bed 46 in the catalytic reforming chamber. Each catalyst particle comprises a carrier made from alumina and a catalyst metal carried by the carrier. The catalyst metal may preferably be selected from a group which consists of Pt, Pd, Rn, Ni, Co, Fe, Cu, Cr, Au and alloys and oxides of these metals and which facilitates dehydration reaction.

The downstream end of the reactor 43 is connected with a pipe 47 extending through the interior of the exhaust manifold 10 and having an outer end connected by a reformed-gas line 48 to the port 20 mentioned previously. A solenoid valve 49 is provided in the line 48 to control the flow of the reformed gaseous mixture through the line 48 to the port 20. A reformed-gas tank 50 is provided and connected to the line 48 in parallel relationship to the solenoid valve 49. The tank 50 is adapted to be operated by means of vacuum and is pneumatically connected by a line 51 to a three-way solenoid valve 52 which in turn is pneumatically connected by a line 52*a* to a vacuum source in the form of a vacuum brake booster 36. The three-way solenoid valve 35 previously mentioned is also pneumatically connected by a line 35*a* to the line 52*a* and thus to the vacuum brake booster 36.

The manifold vacuum port 15 is pneumatically connected by a line 15*a* to a vacuum responsive electric switch 53 which in turn is electrically connected to the three-way solenoid valves 35 and 52 and the solenoid valve 49. The switch 53 is operative to detect variation in the manifold vacuum and is switched on to electrically energize the solenoid valves 35, 49 and 52 when the manifold vacuum as detected becomes smaller than a predetermined value (for example, 100 mmHg), the switch being switched off to deenergize these solenoid valves when the manifold vacuum becomes larger than the predetermined value.

Figure 2:
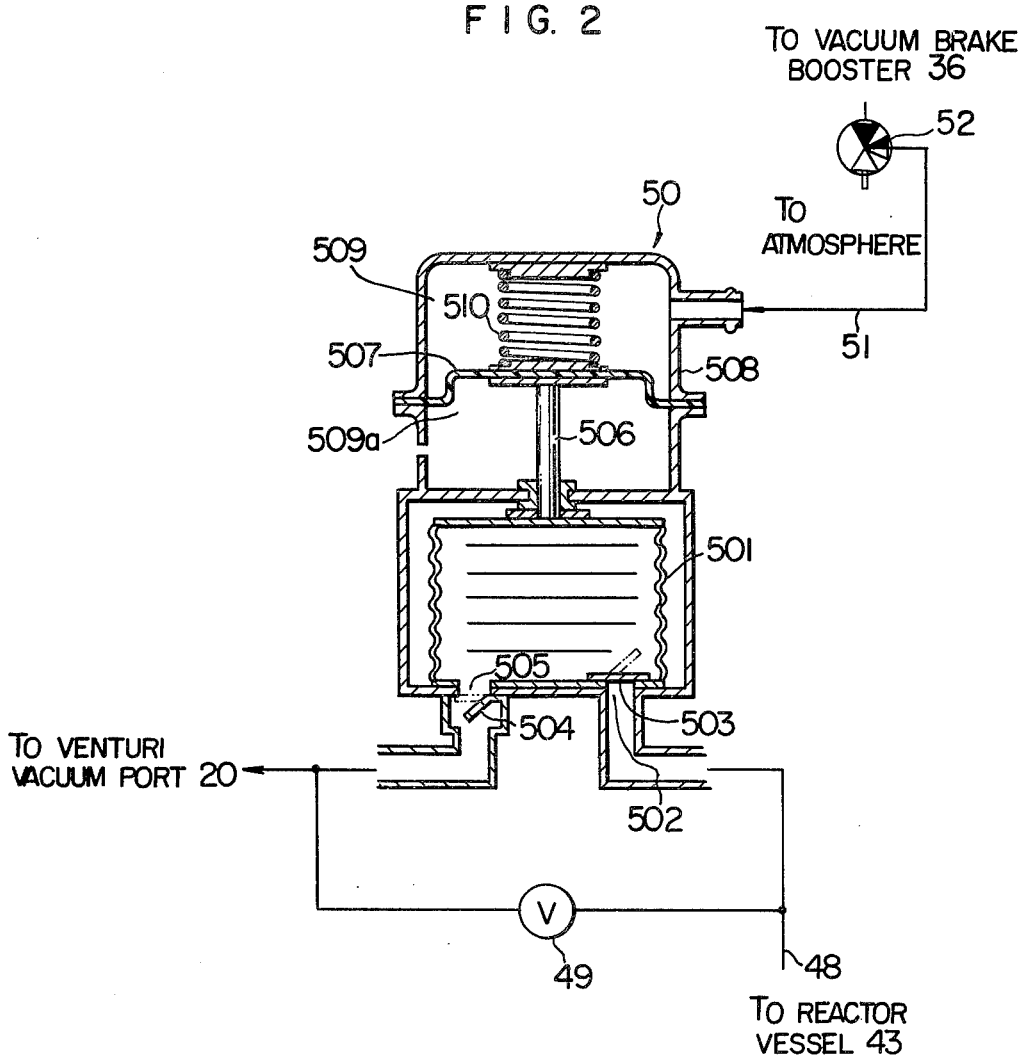
FIG. 2 is an enlarged sectional view of a tank for accumulating a reformed combustible gaseous mixture.

With reference to FIG. 2, the reformed gas tank 50 includes a reservoir 501 formed of an expansible and contractive hollow bellows-like member having a reformed gas inlet 502 connected to the line 48 upstream of the solenoid valve 49 and a reformed gas outlet 505 connected to the line 48 downstream of the solenoid valve 59. Check valves 503 and 504 are provided for the reformed gas inlet and outlet 502 and 505, respectively. The reservoir 501 has a rod 506 connected at one end to an end wall of the reservoir remote from the inlet and outlet 502 and 505. The other end of the rod 506 is connected to a diaphragm 507 disposed in and extending across the interior of a housing 508 to cooperate therewith to define a working chamber 509 which is connected by a line 51 to the three-way solenoid valve 52, and an atmospheric chamber 509*a* always communicated with the atmosphere. A compression coil spring 510 is disposed in the working chamber 509 is resiliently bias the diaphragm 507 toward the atmospheric chamber 509*a*.

The three-way solenoid valve 35 is electrically actuated to connect the vacuum line 35*a* to the line 24 and thus to communicate the EGR valve actuator 21*a* to the vacuum source 36 when the vacuum responsive switch 53 is switched on. When the switch 53 is switched off, the solenoid valve 35 is switched over to disconnect the line 24 and thus the EGR valve actuator 21*a* from the line 35*a* and thus from the vacuum source 36 and connect the line 24 and the EGR valve actuator to the line 23*b* and thus the throttle vacuum modulating valve 30. The solenoid valve 49 is opened and closed when the vacuum responsive switch 53 is switched on and switched off, respectively. The three-way solenoid valve 52 is operative to communicate the working chamber 509 of the reformed gas tank actuator with the atmosphere to introduce the atmospheric air into the chamber 509 when the vacuum responsive switch 53 is switched on. The valve 52 is switched over to communicate the chamber 509 with the vacuum line 52*a* and thus the vacuum source 36 to transmit the brake booster vacuum to the chamber 509 when the vacuum responsive switch 53 is switched off.

During a normal engine operation, a charge of an air-gasoline mixture produced by the main carburetor 17 is fed into the engine 1 on an intake stroke. A part of the mixture charge is introduced through the torch aperture 7*a* into the trap chamber 6. A portion of the air-fuel mixture introduced into the trap chamber 6 flows therein along a loop-like path to scavenge the plug electrodes and is discharged from the trap chamber 6 through the other torch aperture 7*b* into the main combustion chamber 2. The intake stroke is followed by a compression stroke, an ignition and expansion stroke and an exhaust stroke. In the ignition and expansion stroke, the mixture part in the trap chamber 6 is ignited by the spark plug 8 to produce torches which run through the torch apertures 7*a* and 7*b* into the main chamber 2 to ignite the mixture charge therein. The burnt gases are exhausted into the exhaust manifold 10 and flow therethrough into the exhaust pipe 13. The rich mixture passage 42, the reforming reactor 43 and the pipe 47 all disposed in the exhaust manifold 10 are heated by the exhaust gases flowing therethrough.

During normal engine operation, the vacuum in the intake manifold 9 is greater than the predetermined value previously mentioned and the vacuum responsive switch 53 is switched off. Thus, the solenoid valve 35 is kept in a position to pneumatically connect the line 23*b* and the throttle vacuum modulating valve 30 to the line 24 and thus the vacuum chamber 25*b* of the EGR valve actuator 21*a* so that the valve member 26 is lifted to partly open the EGR valve 21 to allow the engine exhaust gases to recirculate at a rate through the line 22 into the intake manifold 9 in conventional manner of EGR. This EGR rate is less than or equal to a predetermined first EGR rate. The solenoid valve 49 is closed at this time. The solenoid valve 52 is in a position to communicate the working chamber 509 of the reformed gas reservoir actuator with the line 52*a* and thus the vacuum brake booster 36 so that the diaphragm 507 is deflected upwardly to expand the reservoir 501 to accumulate therein an amount of reformed combustible gaseous mixture produced in the reforming reactor 43.

During a high load engine operation as in an engine acceleration operation, the vacuum in the intake manifold 9 is smaller than the predetermined value and the vacuum responsive switch 53 is switched on. The solenoid valve 35 is therefore turned to communicate the line 24 and the vacuum chamber 25*b* of the EGR valve actuator 21*a* with the line 35*a* and thus the vacuum brake booster 36 with a result that the EGR valve 21 is fully opened to allow the engine exhaust gases to recirculate back into the intake manifold 9 at a predetermined second rate higher than the first rate mentioned previously.

The solenoid valve 52 is also turned to a position to communicate the working chamber 509 of the reformed gas reservoir actuator with the atmosphere to introduce the atmospheric air into the chamber 509 so that the reservoir 501 is contracted to discharge the reformed combustible gaseous mixture therefrom into the line 48 downstream of the solenoid valve 49. Thus, the reformed combustible gaseous mixture from the reservoir 501 is added through the port 20 to the air-gasoline mixture produced by the main carburetor 17 to increase the engine output. It will thus be appreciated that the reformed gas tank 50 and the associated actuator and reformed gas supply line act as a full-power fuel circuit. The switching-on of the vacuum responsive switch 53 causes the solenoid valve 49 to be opened to apply the venturi vacuum to the reforming reactor 43 and thus to the auxiliary carburetor 40 so that the carburetor produces a rich mixture of air and the fuel to be reformed and this mixture is caused to flow through the rich mixture passage 42 which is heated by the engine exhaust gases in the exhaust manifold 10. The rich mixture which is in liquid state or in the form of liquid droplets is evaporated in the heated passage 42 and introduced into the reforming reactor 43 wherein the rich mixture flows through the catalyst bed 46 and is subjected to catalytic thermal decomposition and partial oxidization reaction so that the rich mixture is converted into a reformed combustible gaseous mixture rich with free hydrogen. The reformed gas flows through the pipe 47, line 48, solenoid valve 49 and port 20 into the primary fuel circuit upstream of the primary throttle valve 18. Thus, it will be noted that, when a high engine load operation is continued for more than a predetermined period of time, the reformed gas is continuously supplied into the fuel circuit from the reforming reactor 43 through the opened solenoid valve 49 but not through the reformed gas tank 50.

As such, the engine 1 is operated with the air-gasoline mixture and the reformed combustible gaseous mixture and with an increased rate of EGR during a high engine load operation. This manner of engine operation is advantageous in that the emission of the harmful components of engine exhaust gases and, particularly, $NO_x$, which has heretofore been increased during a high engine load operation, is decreased. The exhaust gas recirculation at a high rate has heretofore caused poor combustion of mixture charges, but such a poor combustion is eliminated and a stable combustion of fuel charges is achieved according to the present invention. This is because of the addition of the reformed combustible gaseous mixture into the fuel charges to the engine and, more particularly, because of the presence, in the reformed combustible gaseous mixture, of free hydrogen having a burning velocity which is greater than that of gasoline. The addition of the reformed combustible gaseous mixture to the air-gasoline mixture is also effective to increase the engine output, to improve the engine drivability and to decrease the engine output drop at a retarded ignition timing as compared with the case where the engine is operated solely by the air-gasoline mixture. The engine operation according to the present invention reduces the consumption of the expensive reformed gaseous mixture to the minimum and necessary rate for thereby improving the total fuel consumption rate of the engine.

When the operation of the engine 1 is changed from the high load operation to a low or medium load operation, the vacuum responsive switch 53 is switched off so that the solenoid valve 35 is switched over to communicate the vacuum chamber **25*b* of the EGR valve actuator 21*a* with the throttle vacuum modulating valve 30 for thereby decreasing the exhaust gas recirculation to below the predetermined first rate previously mentioned and so that the solenoid valve 49 is closed to discontinue the supply of the reformed combustible gaseous mixture through the line 48 into the fuel circuit. At the same time, the solenoid valve 52 is also switched over to communicate the working chamber 509 of the reformed gas reservoir actuator to expand the reformed gas reservoir 501 so that an amount of the reformed gaseous mixture from the reforming reactor 43 is accumulated in the reservoir 501** so as to be discharged in the next high engine load operation.

When the catalyst bed 46 is at a low temperature at the time of engine start, the catalyst is not sufficiently activated to fully facilitate the production of reformed gaseous mixture. In such a case, the working chamber 509 of the reformed gas reservoir actuator may preferably be supplied with the atmospheric pressure.

With the described and illustrated embodiment of the invention, the reformed gas tank 50 is promptly responsive to a transition to a high engine load operation to supply the reformed combustible gaseous mixture into the fuel circuit. This feature, however, is not essential for the present invention and will not be required for some kinds of internal combustion engines.

However, it should be noted that it is a great advantage for the engine to quickly respond to the engine transition operation from low to high engine load operation because a sufficient amount of reformed combustible gaseous mixture can be supplied through the reformed gas tank 50 into the engine at the beginning of the transition operation and for a certain time period from the beginning which is determined by the capacity of the reservoir 501.

What is claimed is:

1. A method of operating an internal combustion engine of the type that comprises a combustion chamber, an intake system having a fuel circuit for feeding a mixture of air and gasoline into said combustion chamber, an ignition system, an exhaust system, an EGR system for recirculating a part of the engine exhaust gases from the exhaust system back into said intake system, and a fuel reforming system for converting a mixture of air and a fuel into a reformed combustible gaseous mixture rich with free hydrogen, said method comprising the steps of:

detecting the load on the engine;

supplying said combustion chamber with the air-gasoline mixture while recirculating the engine exhaust gases at a rate not higher than a predetermined first EGR rate when the engine load as detected is lower than a predetermined load level; and feeding said combustion chamber with the reformed combustible gaseous mixture in addition to the air-gasoline mixture supply and substantially simultaneously increasing the exhaust gas recirculation to a rate higher than said predetermined first EGR rate when the engine load as detected exceeds said predetermined load level.

2. The engine operating method according to claim 1, wherein the engine intake manifold vacuum is detected to determine the load on the engine.

3. The engine operating method according to claim 1 or 2, wherein an amount of the reformed combustible gaseous mixture produced by the reforming system during at least a part of the engine operation is accumulated in a reservoir and discharged therefrom into the intake system in the initial stage of said reformed gaseous mixture feeding step.

4. An internal combustion engine comprising a combustion chamber, an intake system having a fuel circuit for producing and feeding a mixture of air and gasoline into said combustion chamber all the time while the engine is in operation, an ignition system having a spark plug for igniting fuel charges to said combustion chamber, an intake system having an intake manifold, an exhaust system, an EGR system for recirculating the exhaust gases from said exhaust system back into said intake system, a fuel reforming system for converting a rich mixture of air and a fuel into a reformed combustible gaseous mixture rich with free hydrogen and feeding the reformed mixture into said intake system, said fuel reforming system including means for producing the rich air-fuel mixture, a reforming reactor having an upstream end pneumatically connected to said rich mixture producing means and a reformed gas supply line extending between the downstream end of said reforming reactor and said intake system, said EGR system including an EGR line extending between said intake and exhaust systems, and means responsive to variation in the load on the engine to control the exhaust gas recirculation and the supply of the reformed combustible gaseous mixture from said reforming reactor into said intake system, the arrangement being such that the exhaust gases are recirculated back into said intake system at a rate not higher than a predetermined first EGR rate when the engine load is lower than a predetermined load level and such that the reformed combustible gaseous mixture is fed from said fuel reforming system into said intake system and substantially simultaneously the exhaust gas recirculation is increased to a rate higher than said predetermined first EGR rate when the engine load exceeds said predetermined load level.

5. The internal combustion engine according to claim 4, wherein said load responsive control means comprise first valve means in said EGR line, a second valve means in said reformed gas supply line and means responsive to variation in the intake manifold vacuum to control said first and second valve means such that, when the intake manifold vacuum is greater than a predetermined vacuum level, said first valve means is partly opened to allow the engine exhaust gases to recirculate at a rate not higher than said predetermined first EGR rate and said second valve means is closed and such that, when the intake manifold vacuum becomes smaller than said predetermined vacuum level, said first valve means is fully opened to allow the engine exhaust gases to recirculate at a predetermined second rate higher than said predetermined first EGR rate and said second valve means is opened to allow the reformed combustible gaseous mixture produced by said reforming reactor to flow therefrom through said second valve means into said intake system.

6. The internal combustion engine according to claim 5, wherein said fuel reforming system further includes a reservoir for the reformed combustible gaseous mixture, said reservoir having an inlet and outlet pneumatically connected to said reformed gas supply line upstream and downstream of said second valve means, respectively, and means for operating said reservoir, said reservoir operating means including check valves for said inlet and outlet, respectively, and means for varying the volume of said reservoir, said reservoir volume varying means being operatively associated with said vacuum responsive control means, the arrangement being such that an amount of reformed combustible gaseous mixture is accumulated in said reservoir when said second valve means is closed and such that, as soon as the manifold vacuum becomes smaller than said predetermined vacuum level, the volume of said reservoir is decreased to discharge the accumulated amount of the reformed combustible gaseous mixture from said reservoir through said outlet into said reformed gas supply line and thus into said intake system.

7. The internal combustion engine according to claim 5 or 6, wherein said vacuum responsive control means comprise a pneumatic valve actuator operatively connected to said first valve means, an electrically operated first three-way valve pneumatically connected to said pneumatic valve actuator, a first vacuum source, a first vacuum line extending between said first three-way valve and said first vacuum source, a second vacuum source, a second vacuum line extending between said first three-way valve and said second vacuum source, said second vacuum source being kept at a vacuum level greater than said first vacuum source, and a vacuum responsive electric switch pneumatically connected to said intake manifold and electrically connected to said electrically operated first three-way valve, the arrangement being such that, when the intake manifold vacuum is greater than said predetermined vacuum level, said three-way valve pneumatically connects said pneumatic valve actuator to said first vacuum source to partly open said first valve means and such that, when the intake manifold vacuum becomes smaller than said predetermined vacuum level, said first three-way valve pneumatically connects said pneumatic valve actuator to said second vacuum source to fully open said first valve means.

8. The internal combustion engine according to claim 7, wherein said fuel circuit of said intake system includes a throttle valve and wherein said first vacuum source comprises a throttle vacuum line pneumatically connecting said first three-way valve to said fuel circuit adjacent to said throttle valve and said second vacuum source comprises a vacuum brake booster.

9. The internal combustion engine according to claim 8, wherein a throttle vacuum modulator is provided in said throttle vacuum line and comprises means defining a passage forming a part of said throttle vacuum line and also defining an opening adapted to communicate said passage to the atmosphere, and a third valve means operable in response to the variation in the exhaust gas pressure to control the communication between said passage and the atmosphere for thereby modulating the throttle vacuum when said three-way valve connects said throttle vacuum line to said pneumatic actuator.

10. The internal combustion engine according to claim 6, wherein said reservoir comprises an expansible and contractive hollow member and said reservoir volume varying means comprises a pneumatically operated second actuator operatively connected to said hollow member, and wherein said vacuum responsive control means comprise an electrically operated second three-way valve pneumatically connected to said second actuator, first and second pneumatic pressure sources of different pressure levels, and a vacuum responsive electric switch pneumatically connected to said intake manifold and electrically connected to said electrically operated second three-way valve, the arrangement being such that, when the intake manifold vacuum is greater than said predetermined vacuum level, said second three-way valve pneumatically connects said second actuator to one of said first and second pneumatic pressure sources to expand said reservoir and such that, when the intake manifold vacuum becomes smaller than said predetermined vacuum level, said second three-way valve pneumatically connects said second actuator to the other of said first and second pneumatic pressure sources to contract said reservoir.

11. The internal combustion engine according to claims 4, 5, 6 or 10, wherein said rich mixture producing means comprises an auxiliary carburetor and said reforming reactor comprises a reactor vessel containing therein a catalyst bed disposed in heat exchange relationship with the engine exhaust gases.

12. The internal combustion engine according to claim 11, wherein said combustion chamber comprises a main combustion chamber and a trap chamber having at least one torch aperture through which said main combustion chamber is communicated with said trap chamber, said torch aperture being disposed to introduce a part of a combustible mixture charge to said combustion chamber into said trap chamber during an intake stroke of the engine, said spark plug having a set of electrodes exposed to said trap chamber to ignite the part of the mixture charge introduced into said trap chamber for thereby producing a torch running through said torch aperture into said main combustion chamber to ignite the mixture therein.

13. The internal combustion engine according to claim 7 wherein said rich mixture producing means comprises an auxiliary carburetor and said reforming reactor comprises a reactor vessel containing therein a catalyst bed disposed in heat exchange relationship with the engine exhaust gases.

14. The internal combustion engine according to claim 13 wherein said combustion chamber comprises a main combustion chamber and a trap chamber having at least one torch aperture through which said main combustion chamber is communicated with said trap chamber, said torch aperture being disposed to introduce a part of a combustible mixture charge to said combustion chamber into said trap chamber during an intake stroke of the engine, said spark plug having a set of electrodes exposed to said trap chamber to ignite the part of the mixture charge introduced into said trap chamber for thereby producing a torch running through said torch aperture into said main combustion chamber to ignite the mixture therein.

15. The internal combustion engine according to claim 8 wherein said rich mixture producing means comprises an auxiliary carburetor and said reforming reactor comprises a reactor vessel containing therein a catalyst bed disposed in heat exchange relationship with the engine exhaust gases.

16. The internal combustion engine according to claim 15 wherein said combustion chamber comprises a main combustion chamber and a trap chamber having at least one torch aperture through which said main combustion chamber is communicated with said trap chamber, said torch aperture being disposed to introduce a part of a combustible mixture charge to said combustion chamber into said trap chamber during an intake stroke of the engine, said spark plug having a set of electrodes exposed to said trap chamber to ignite the part of the mixture charge introduced into said trap chamber for thereby producing a torch running through said torch aperture into said main combustion chamber to ignite the mixture therein.

17. The internal combustion engine according to claim 9 wherein said rich mixture producing means comprises an auxiliary carburetor and said reforming reactor comprises a reactor vessel containing therein a catalyst bed disposed in heat exchange relationship with the engine exhaust gases.

18. The internal combustion engine according to claim 17 wherein said combustion chamber comprises a main combustion chamber and a trap chamber having at least one torch aperture through which said main combustion chanber is communicated with said trap chamber, said torch aperture being disposed to introduce a part of a combustible mixture charge to said combustion chamber into said trap chamber during an intake stroke of the engine, said spark plug having a set of electrodes exposed to said trap chamber to ignite the part of the mixture charge introduced into said trap chamber for thereby producing a torch running through said torch aperture into said main combustion chamber to ignite the mixture therein.

* * * * *